US007483653B2

(12) United States Patent
Maruno

(10) Patent No.: US 7,483,653 B2
(45) Date of Patent: Jan. 27, 2009

(54) IMAGE SCANNER

(75) Inventor: Nobuyuki Maruno, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 217 days.

(21) Appl. No.: 11/639,412

(22) Filed: Dec. 15, 2006

(65) Prior Publication Data

US 2007/0154241 A1 Jul. 5, 2007

(51) Int. Cl.
*G03G 15/00* (2006.01)

(52) U.S. Cl. ..... 399/211; 399/212

(58) Field of Classification Search ..... 399/177, 399/206, 208, 210, 211; 474/101, 115, 117, 474/136; 358/461, 464
See application file for complete search history.

(56) References Cited

U.S. PATENT DOCUMENTS 5,982,948 A * 11/1999 Shimada et al. ..... 382/274
6,690,494 B1 * 2/2004 Yamada ..... 358/497
2002/0149802 A1 * 10/2002 Aoki ..... 358/461
2006/0240924 A1 * 10/2006 Osakabe et al. ..... 474/117

FOREIGN PATENT DOCUMENTS

JP 2001-296616 10/2001
JP 2001-337400 12/2001

* cited by examiner

*Primary Examiner*—Hoan H Tran
(74) *Attorney, Agent, or Firm*—Morgan, Lewis & Bockius L

(57) ABSTRACT

An image scanner is provided and includes a case having a document placement surface, two carriages which are mounted with optical components and move by running on rails, a wire drive mechanism for reciprocating the two carriages which are coupled to wires, and a movement restricting member for restricting a maximum movement distance of the first carriage in a stationary position mode to about 1.6 d or less, d being a groove depth of pulleys in mm and the maximum movement distance being a distance by which the first carriage is allowed to move in the read scanning direction in the stationary position mode in which the first carriage is kept stopped and fixed via the wires by moving the second carriage by causing the wire drive mechanism to operate so that the second carriage hits the fixedly disposed member to be stopped and fixed.

2 Claims, 13 Drawing Sheets

IMAGE SCANNER

BACKGROUND (i) Technical Field

The present invention relates to an image scanner for reading image information of a document. And the invention relates to an image scanner which is not only used alone but also used as, in particular, an image reading unit of an image forming apparatus such as a copier or a multifunction machine which utilizes image information read from a document.

(ii) Related Art

As one example of image scanners used in copiers and multifunction machines, there is one in which two carriages mounted with optical components such as an illumination lamp and reflection mirrors in a distributed manner are reciprocated under the bottom surface of a platen glass as a document stage (document placement surface) inside a case to which the platen glass is attached and an image of image information of a document placed on the platen glass is formed on an image sensor such as a CCD (charge-coupled device) linear sensor or directly formed an image carrying body such as a photoreceptor body via optical components such as an image forming lens. There is another image scanner in which even the image sensor is mounted on the carriages.

In the above image scanners, in general, the two carriages are supported so as to run on rails that are disposed along the read scanning direction which is parallel with the surface of the platen glass, and a wire drive mechanism is employed which reciprocates, at a movement distance ratio, the carriages which are connected to wires each of which is wound on and stretched between plural pulleys.

However, in this case, since the carriages are merely held by the wire on the rails, they may swing widely when vertical vibration is applied to them, as a result of which the reflection mirrors mounted thereon may be damaged, deviated in position, or subjected to other trouble. Such trouble most likely occurs when, for example, an image scanner is transported after its manufacture or in changing its installation location because unexpected impact may be exerted on it many times as external force in such a situation.

As for the carriage locations, for example, FIG. 3A shows a state that carriages 20 and 25 are located at home positions and FIG. 3B shows a state that the carriages 20 and 25 are located at transport positions.

In the image scanner of the related art, in the transport position mode, since as shown in FIG. 3B at least the one carriage 25 is located at the very end position in the read scanning direction so as to be set close to the pulleys 43, its swing width can be minimized even when vertical vibration is exerted on it. However, the following phenomenon may occur.

In the transport position mode, since the other carriage 20 merely kept in a state that it is stopped and fixed on the rails via wires 41, it may move in the read scanning direction X2 when impact is exerted on it during a transport. If this carriage is moved in the read scanning direction X2, wire portions connected to it are also moved and loosened. Those wire portions may come off the closest pulleys (e.g., the pulleys 44) on which those wire portions are wound.

One countermeasure is such that the other carriage is also fixed completely in position by pressing it against a fixedly disposed member. However, in this case, impact occurring during a transport is transmitted to the carriage via the fixedly disposed member without being weakened and may adversely affect the optical components mounted on the carriage.

SUMMARY

According to an aspect of the invention, there is provided a image for a document, comprising:

a case having a document placement surface on which a document is placed;

rails disposed inside the case along a read scanning direction which is parallel with the document placement surface;

two carriages comprising a first carriage and a second carriage which have optical components and move by running on the rails;

a fixedly disposed member disposed on one end side in the read scanning direction, the fixedly disposed member stopping and fixing one of the two carriages;

a wire drive mechanism having a plurality of pulleys and wires each of which is wound on and stretched between the plurality of pulleys, the wire drive mechanism reciprocating the two carriages which are coupled to the wires; and a movement restricting member that restricts a maximum movement distance of the first carriage in a stationary position mode to about 1.6 d or less, d being a groove depth of pulleys in mm and the maximum movement distance being a distance by which the first carriage is allowed to move in the read scanning direction in the stationary position mode in which the first carriage is kept stopped and fixed via the wires by moving the second carriage by causing the wire drive mechanism to operate so that the second carriage hits the fixedly disposed member to be stopped and fixed.

DETAILED DESCRIPTION

Figure 1:
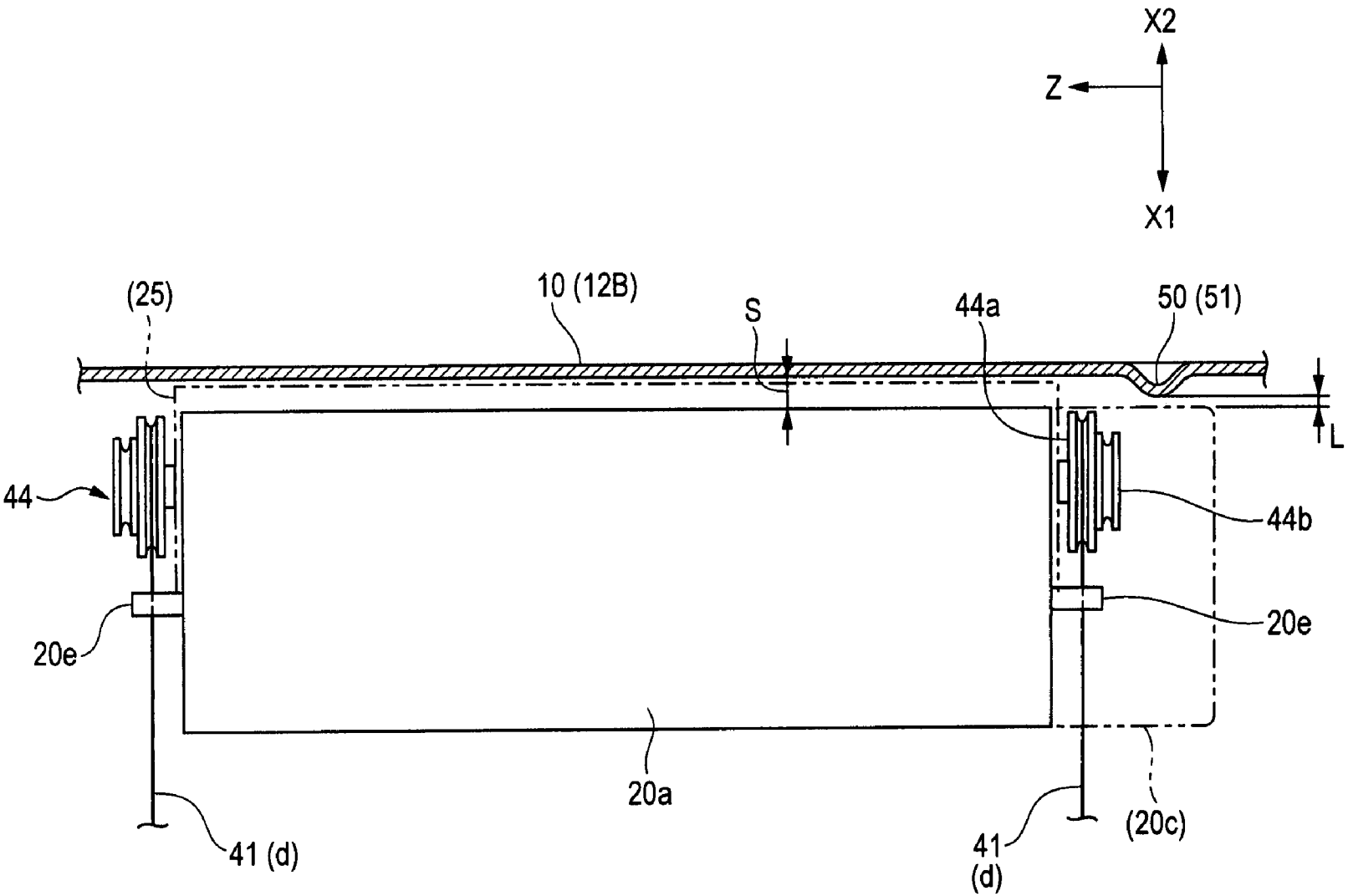
FIG. 1 is a partially sectional explanatory diagram (top view) showing structures of and a relationship between a first carriage located at a transport position and a movement restricting member.

An exemplary embodiment of the invention will be discussed with reference to the accompanying drawings.

First, the reason why, as described above, the maximum movement distance which is attained by the movement restricting member is set at about 1.6 d or less in the image scanner according to an exemplary embodiment of the invention is as described below. The maximum movement distance L at least does not include zero (0<L). It is better that the maximum movement distance L be smaller than or equal to $(\pi/2)d$, and it is even better that the maximum movement distance L be smaller than or equal to d. Restricting the maximum movement distance L to such better values makes it possible to prevent, more reliably, the wires from coming off the pulleys, as well as to make even shorter the distance by which the other carriage is allowed to move in the read scanning direction in the stationary position mode. The depth d of the pulley groove is the height-direction distance from the bottom of the pulley groove to the flange tops (see FIG. 11) in the case where the wire is wound so as to be brought in contact with the bottom of the pulley groove.

No particular limitations are imposed on the structure, the location, etc. of the movement restricting member as long as it can restrict the maximum movement distance in the read scanning direction. However, from the viewpoints of the cost, reduction in the number of components, etc., it is advantageous, over a case of providing the movement restricting member as a new component, to form the movement restricting member as a portion of the case. The movement restricting member is only required to restrict (the distance of) movement of the other carriage at least in one of the two directions of the read scanning direction, the one direction being such that the wires may come of the pulleys if a movement occurs in that direction. That is, there is no particular reason to restrict movement in both directions.

Furthermore, the movement restricting member may be a drawn projection that is formed by bending a portion of the case (e.g., a portion of a frame that is located on such a side as to face the other carriage being located at the stationary position). In this case, since the drawn projection is connected to the case at two locations, it is higher in mechanical strength than a bent portion that is erected by cutting the case and is connected to the case at only one end. Should the other carriage hits the drawn projection, the drawn projection is never deformed or damaged.

Usually, the other carriage is a carriage that is mounted with optical components including a reflection mirror and a light source for illuminating a document. However, it may be a carriage that is not mounted with a light source. Usually, the fixedly disposed member is part of the case (e.g., a frame that is located on such a side as to face the one carriage being located at the stationary position). However, the invention is not limited to such a case. For example, it may be a member that is not part of the case and is fixed to the case. For example, the stationary position mode is used in transporting the image scanner or moving it in changing its installation location.

An exemplary embodiment of the invention will be hereinafter described in more detail.

FIGS. 2-6 mainly show fundamental components of the image scanner according to an exemplary embodiment of the invention. For example, the image scanner according to an exemplary embodiment is used as an image reading unit of a digital copier.

Figure 2:
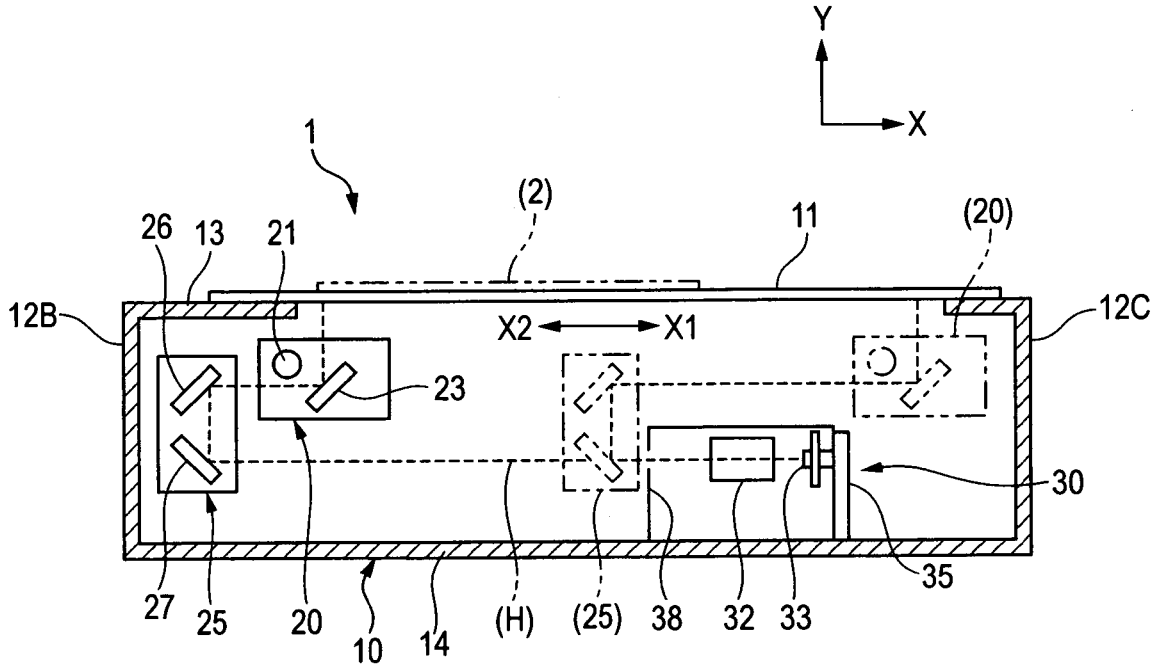
FIG. 2 is an explanatory diagram showing components of an image scanner according to an exemplary embodiment.
Figure 3A:
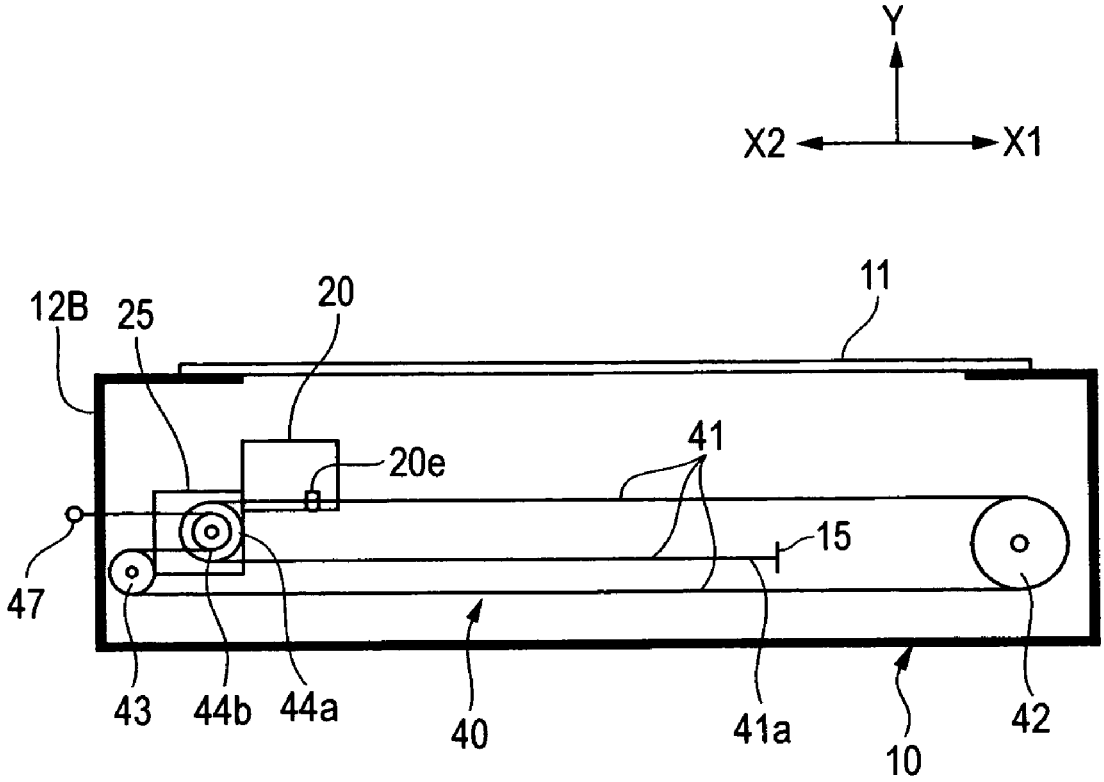
FIGS. 3A and 3B are explanatory diagrams showing home positions and transport positions of two carriages.
Figure 3B:
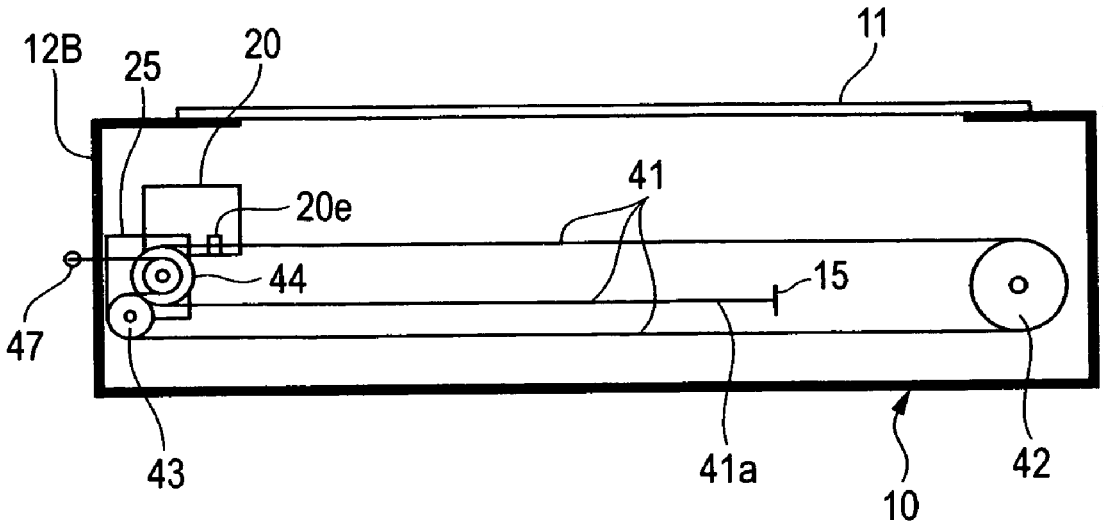
Figure 4:
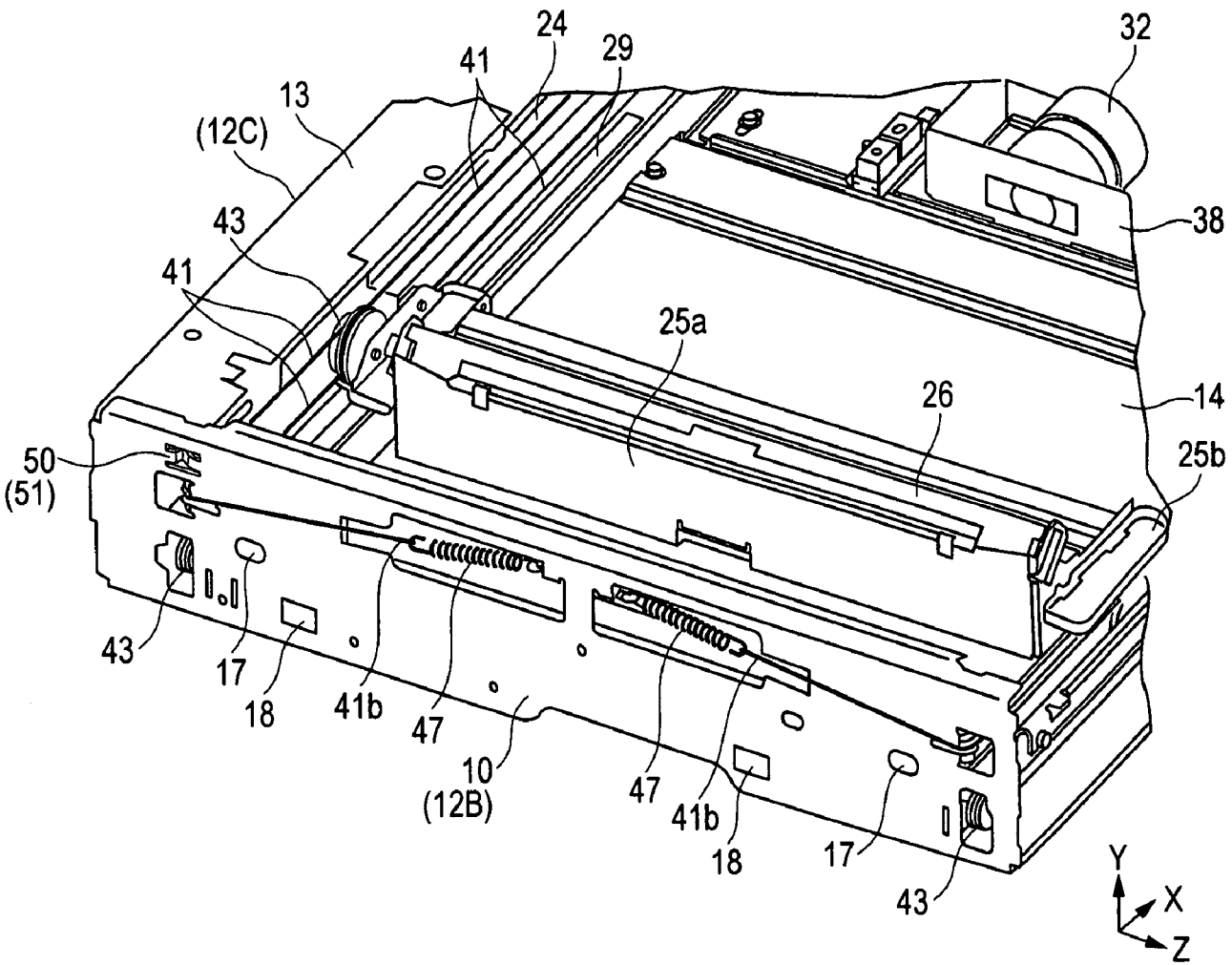
FIG. 4 is a partial perspective view showing a part of the image scanner.

As shown in FIGS. 2-4 etc., the image scanner 1 has a box-shaped case 10 which is opened on the top side. A platen glass 11 on which a document 2 is placed with its information-bearing surface down is fitted in the top opening portion of the case 10. In the image scanner 1, a first carriage 20 and a second carriage 25 which constitute a reduction image-forming optical system, a reading unit 30 for finally reading image information of the document 2, and a wiring drive mechanism 40 for reciprocating the carriages 20 and 25 are disposed in the internal space of the case 10 which is located under the platen glass 11. The case 10 is mainly formed by outer frames 12A, 12B, 12C, and 12D (four walls; the outer frames 12A and 12D are not shown), a top plate frame 13 which is disposed on the top side of the outer frames and is formed with the above-mentioned top opening portion, and a bottom frame 14 which is disposed under the outer frames. An exterior cover is finally attached to the outer frames 12, and plural fixing holes 18 for attachment of the exterior cover are formed in the outer frames 12 (see FIG. 4).

The first carriage 20 includes a carriage main body 20*a* and brackets 20*b* and 20*c* which are attached to the main body 20*a* at both ends, and is a full-rate scanning movement body which is reciprocated at the same speed as a movement speed on first slide rails 24 (see FIGS. 4 and 9) which are provided inside the case 10 along the read scanning direction (auxiliary scanning direction) X which is parallel with the surface of the platen glass 11. In the carriage 20, the bottom surfaces of the brackets 20*b* and 20*c* are provided with plural sliding legs 20*d*. The carriage 20 is moved as the sliding legs 20*d* slide on the slide rails 24 (see FIGS. 6, 7, etc.). (The main body 20*a* of) the first carriage 20 is mainly mounted with a lamp (e.g., halogen lamp or fluorescent lamp) 21 as a light source for illuminating the information-bearing surface of the document 2 and a reflection mirror 23 for reflecting, to the second carriage 25, reflection light H (a broken line H in FIG. 2 indicates its optical axis) coming from the document 2 being illuminated by the lamp 21.

The second carriage 25 includes a main body 25*a* and brackets 25*b* and 25*c* which are attached to the main body 25*a* at both ends, and is a half-rate movement body which is reciprocated in link with the movement of the first carriage 20 at a speed that is a half of the speed of the first carriage 20 in the same read scanning direction on second slide rails 29 (see FIGS. 4 and 9) which are provided inside the case 10 along the read scanning direction X. In the carriage 25, the bottom surfaces of the brackets 25*b* and 25*c* are provided with plural sliding legs 25*d*. The carriage 25 is moved as the sliding legs 25*d* slide on the slide rails 29 (see FIGS. 6, 7, etc.). (The main body 25*a* of) the second carriage 25 is mounted with two reflection mirrors 26 and 27 for reflecting, to the reading unit 30, the reflection light H originating from the document 2 and reflected by the reflection mirror 23.

In the reading unit 30, an image-forming lens 32 for forming an image of the reflection light H originating from the document and reflected by the reflection mirrors 26 and 27 of the second carriage 25 and an imaging device 33 such as a CCD line sensor for reading, through photoelectric conversion, the reflection light H originating from the document and image-formed by the image-forming lens 32 are mounted at positions (close to outward-to-homeward reversing positions of reciprocation movements of the carriages 20 and 25) located on the bottom surface side of the case 10. Of the above components, the imaging device 33 is mounted on a circuit board 35 for driving it, and the circuit board 35 is fixed to the case 10 via a bracket or the like (not shown). In the reading unit 30, part of the image-forming lens 32 and the imaging device 33 are covered with a shield cover 38 (the image-forming lens 32 and the imaging device 33 are reading optical components of the reading unit 30).

The wire drive mechanism 40 mainly includes two wires 41, plural pairs of pulleys 42, 43, and 44 on and between which the wires 41 are wound and stretched, and a drive motor 45.

Figure 5:
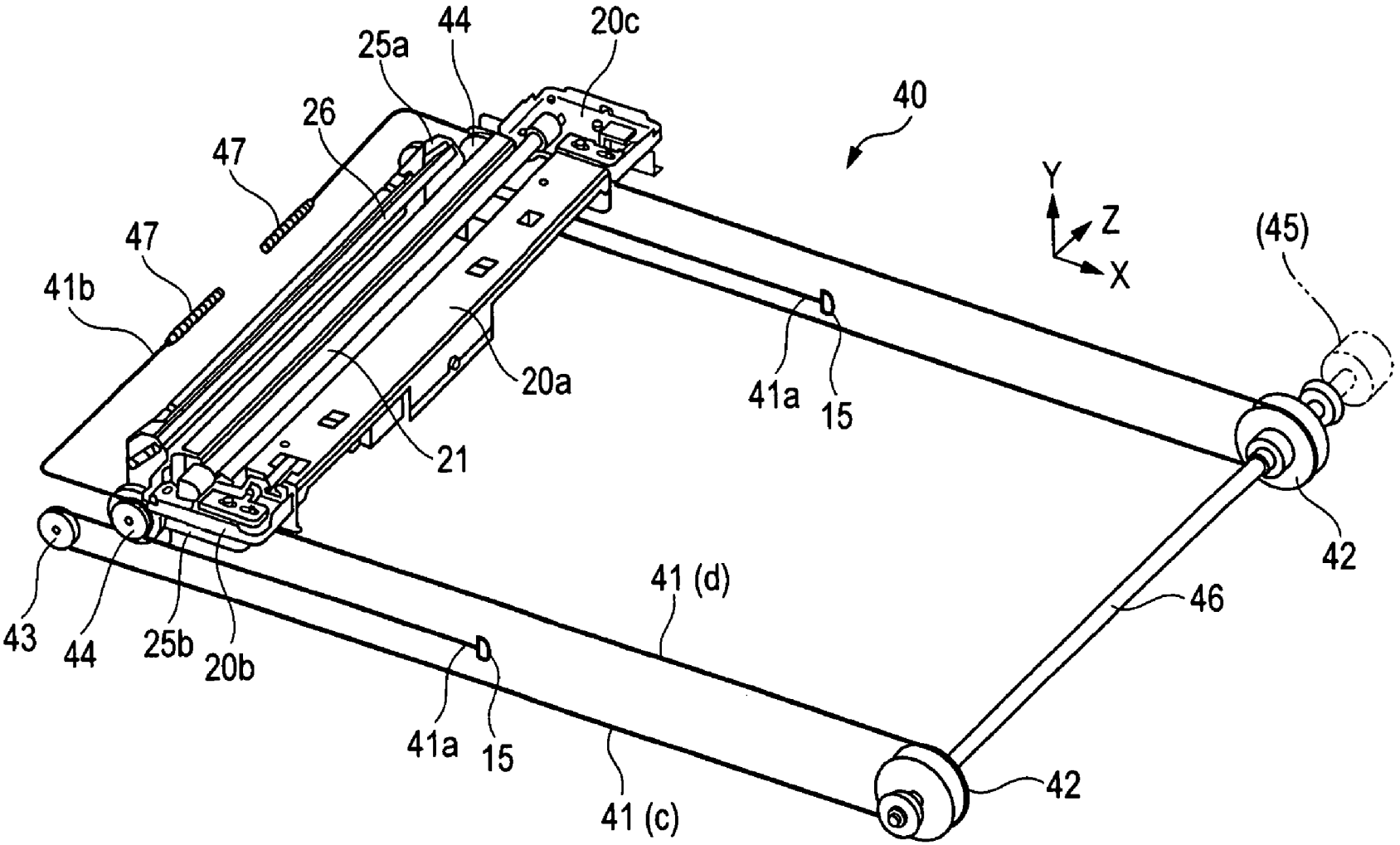
FIG. 5 is a perspective view as viewed from above showing the two carriages located at the home positions and a wire drive mechanism.

In the wire drive mechanism 40 of this exemplary embodiment, as shown in FIGS. 3A and 3B, FIG. 5, etc., two drive pulleys 42 are attached to a drive shaft 46 which is disposed rotatably so as to be parallel with the direction Z (main scanning direction, perpendicular to the read scanning direction X) in an end portion inside the case 10 where the imaging device 33 of the reading unit 30 is disposed. Two fixed pulleys 43 are disposed rotatably at such positions as to be opposed to the two respective pulleys 42 in an end portion inside the case 10 that is opposite to the end portion where the drive pulleys 42 are disposed. Two double-groove pulleys 44 are rotatably attached to both end portions (brackets 25*b* and 25*c*) of the second carriage 25. The drive motor 45 is a stepping motor, for example, and its rotary drive shaft is connected to the above-mentioned drive shaft 46 directly or via a drive transmission mechanism.

The two wires 41 are wound around the two respective drive pulleys 42 plural times (in FIG. 5 etc., each wire is not drawn so as to be wound on the associated drive pulley plural times). One wire end portion 41*a* of each wire is connected to the first carriage 20, then wound on a large-diameter-groove pulley 44*a* of the double-groove pulley 44, and finally attached (fixed) to a fixedly attaching portion 15 of the case 10. The wires 41 are strongly fixed by means of wire fixedly holding portions 25*e* which are provided on the bottom surfaces of the brackets 25*b* and 25*c* of the first carriage 20, respectively. The other wire end portion 41*b* of each wire is wound on the fixed pulley 43, then wound on a small-diameter-groove pulley 44*b* of the double-groove pulley 44, and finally attached the case 10 via a tension spring 47 in a state that it is led outside the outer frame 12B of the case 10.

In the wire drive mechanism 40, the drive motor 45 is rotated at a speed in a direction. Resulting rotary motive power is transmitted to the first carriage 20 and the second carriage 25 via the wires 41 which are wound on and stretched between the plural pairs of pulleys 42-44, and reciprocates the first carriage 20 and the second carriage 25 in the read scanning direction X. In FIG. 1 etc., arrow directions X1 and X2 correspond to an outward path and a homeward path of a reciprocation movement, respectively. In the wire drive mechanism 40, the pulleys 42-44 are disposed and the wires 41 are wound and stretched in the above-described manner so as to utilize the principle of the movable pulley. Therefore, the displacement of the half-rate second carriage 25 is a half of that of the full-rate first carriage 20 when they are moved.

Figure 6:
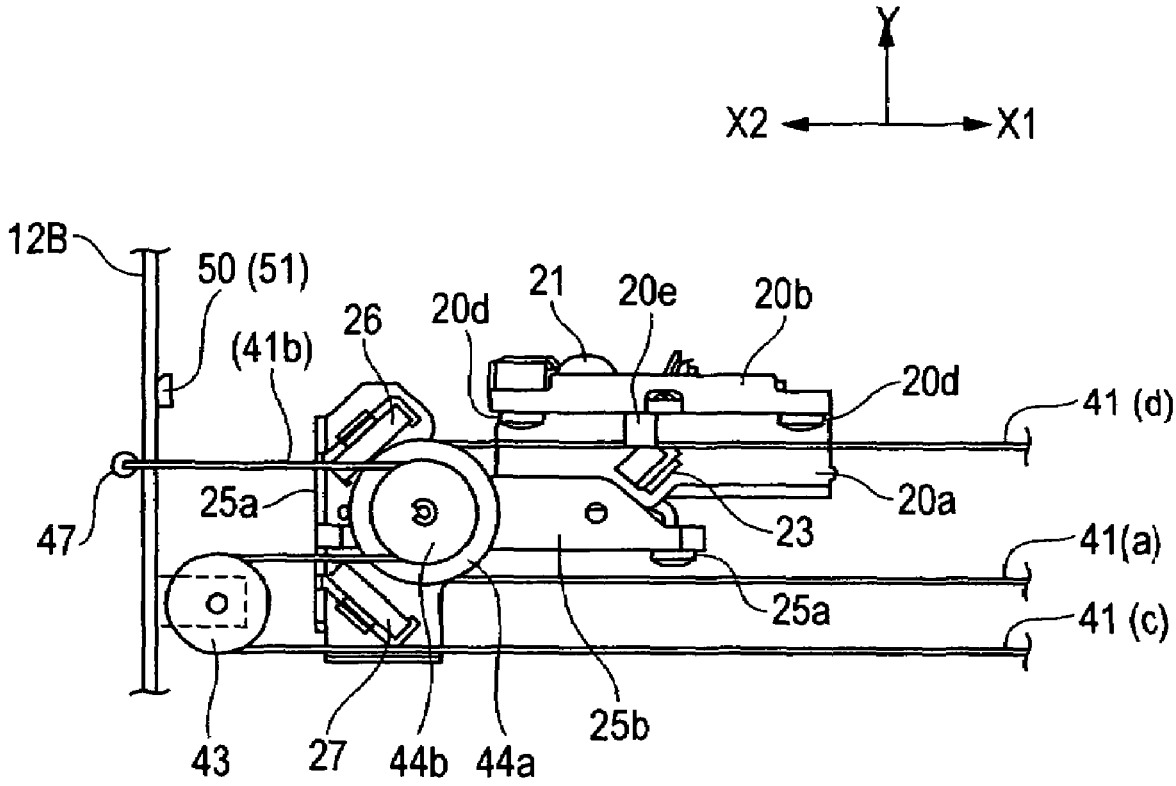
FIG. 6 is a detailed diagram of components showing the two carriages located at the home positions and an outer frame.
Figure 7:
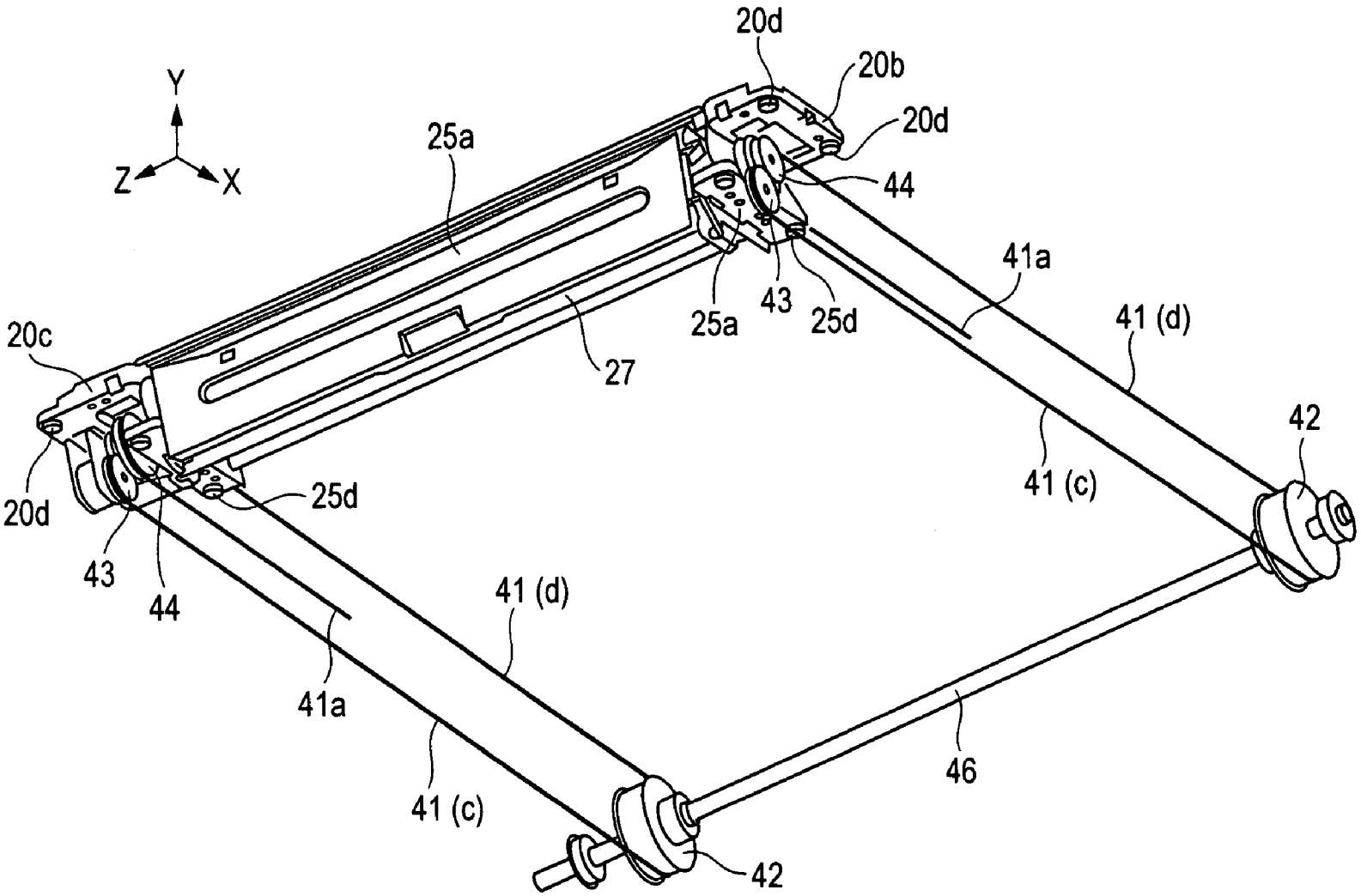
FIG. 7 is a perspective view as viewed from below showing the two carriages located at transport positions and the wire drive mechanism.
Figure 8:
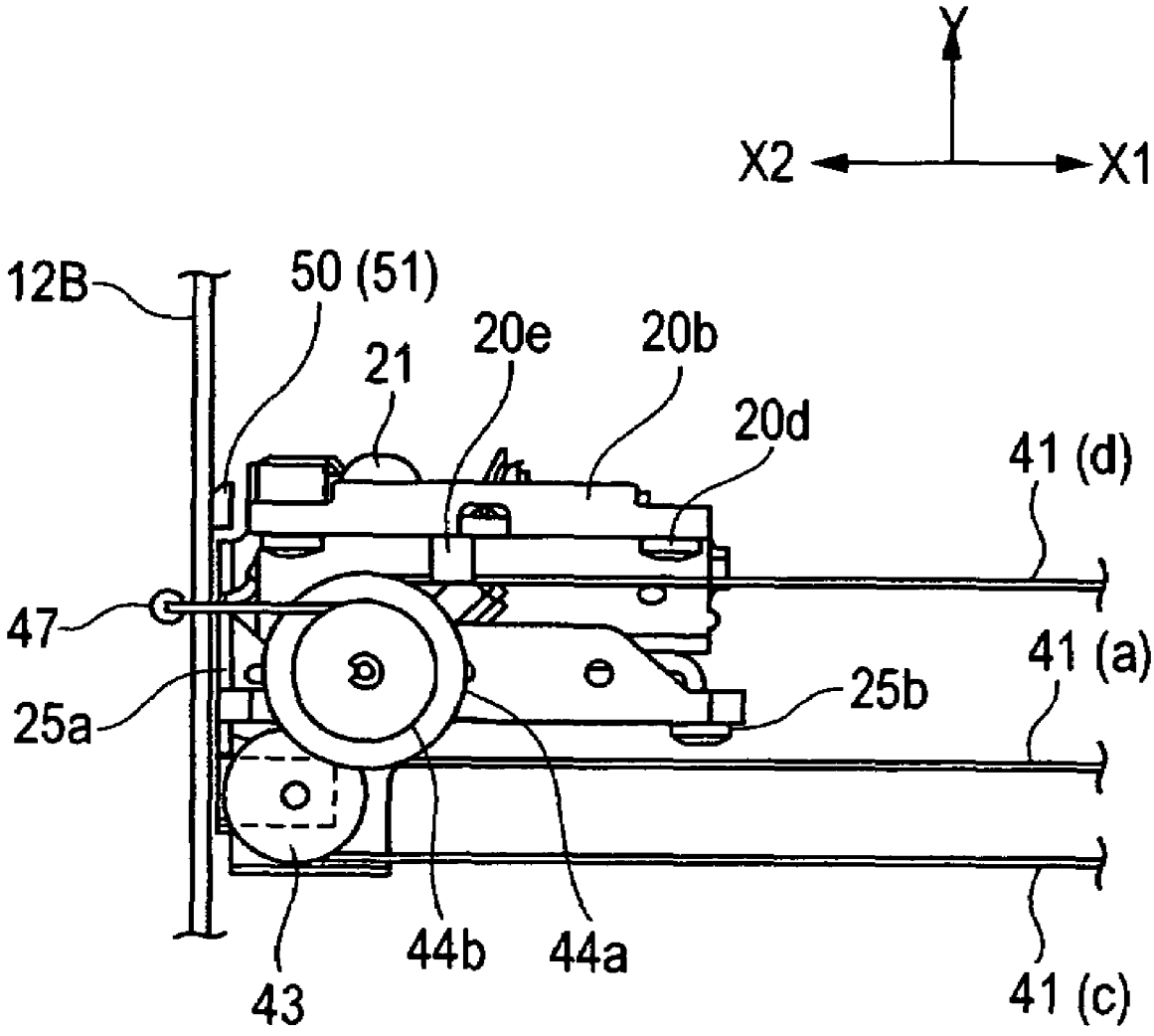
FIG. 8 is a detailed diagram of components showing the two carriages located at the transport positions and the outer frame.

In the image scanner 1, as shown in FIGS. 3A, 5, 6, etc., the two carriages 20 and 25 are moved to their home positions (standby reference positions) and stopped there by operating the wire drive mechanism 40 (drive motor 45) by a control operation of a control section (not shown; includes sensors for detecting position information of the carriages). Furthermore, as shown in FIGS. 3B, 7, 8, etc., the two carriages 20 and 25 are moved to their transport (stationary) positions and stopped and fixed there by operating the wire drive mechanism 40. Movement to the transport positions is performed by selecting a transport position mode and making an input (instruction) through an information input section (e.g., input keys and switches on an operating panel) for the control section of the image scanner 1.

Basic image reading by the above-configured image scanner 1 is performed as follows.

First, when a document 2 as a subject of reading is placed on the platen glass 11 with its information-bearing surface down manually or by an automatic document feeder, the first carriage 20 and the second carriage 25 start to be moved with a timing from the home positions in the arrow direction X1 (outward path). As they are moved, the information-bearing surface of the document 2 is illuminated by the lamp 21 and a scan is performed in the main scanning direction which is perpendicular to the read scanning direction X. A scan is also performed in the auxiliary scanning direction (read scanning direction X) as the first carriage 20 and the second carriage 25 are moved in the arrow direction X1 (outward path) because of operation of the wire drive mechanism 40.

While the above scans are performed, reflection light H from the document 2 being illuminated shines on the image-forming lens 32 after passing the mirror 23 and the mirrors 26 and 27 in this order, whereby image information of the document 2 is read electrically. The image information of the document that is read by the imaging device 33 (i.e., a resulting electrical signal) is sent to an image processing section of a copier main body via the circuit board 35.

In the image scanner 1, movement of the first carriage 20 and the second carriage 25 to the transport positions is performed as follows.

In an operation of movement to the transport positions, first, the drive motor 45 of the wire drive mechanism 40 is operated and rotated in such a direction that the drive pulleys 42 take up wire portions 41*c* that are wound on the fixed pulleys 43 while paying out wire portions 41*d* that are connected to the first carriage 20 and wound on the double-groove pulleys 44. As a result, the first carriage 20 and the second carriage 25 which have been located at the home positions (see FIGS. 3A, 6, etc.) receive motive power from the wires 41 and are moved on the slide rails 24 and 29 in the arrow direction X2 of the read scanning direction.

Figure 9:
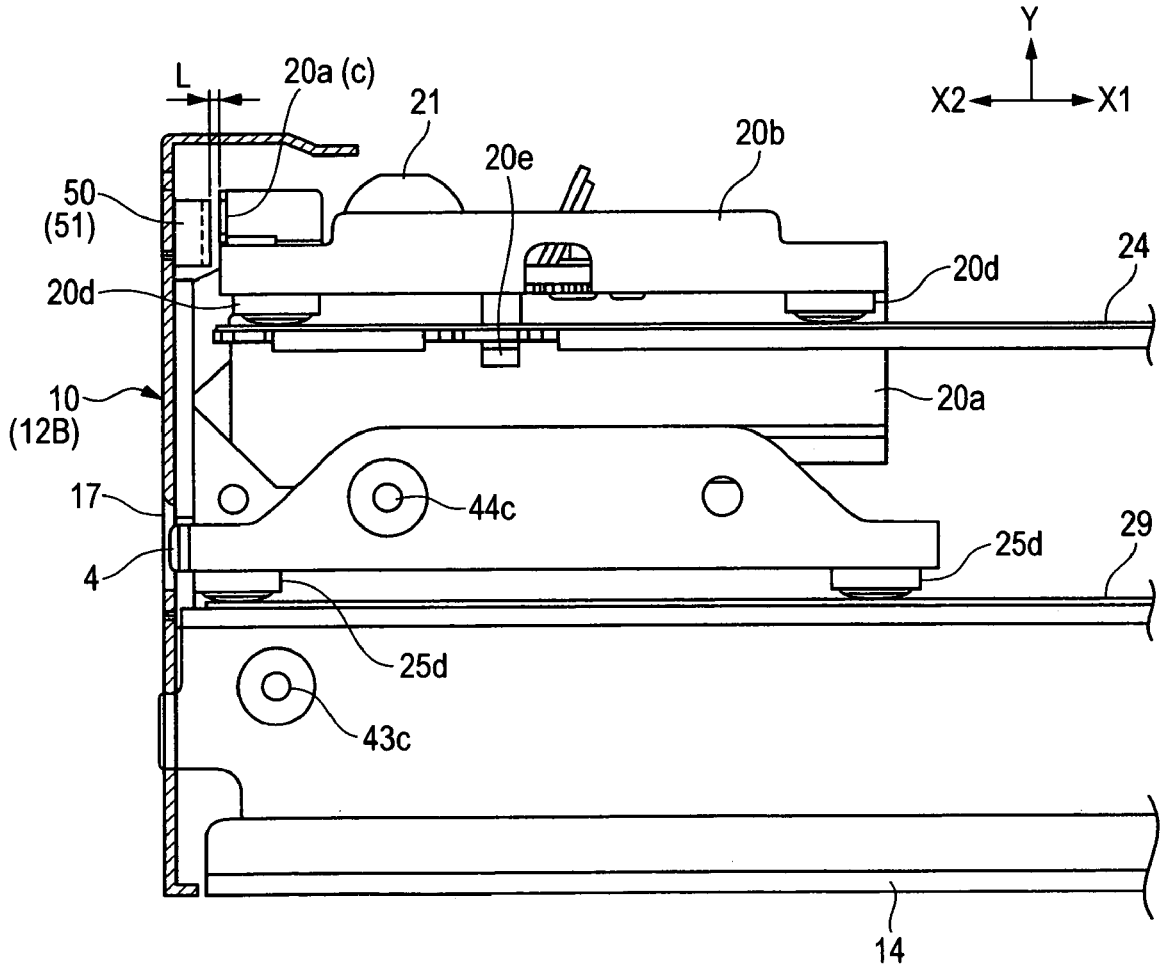
FIG. 9 is a schematic enlarged view of a part of FIG. 8.
Figure 10:
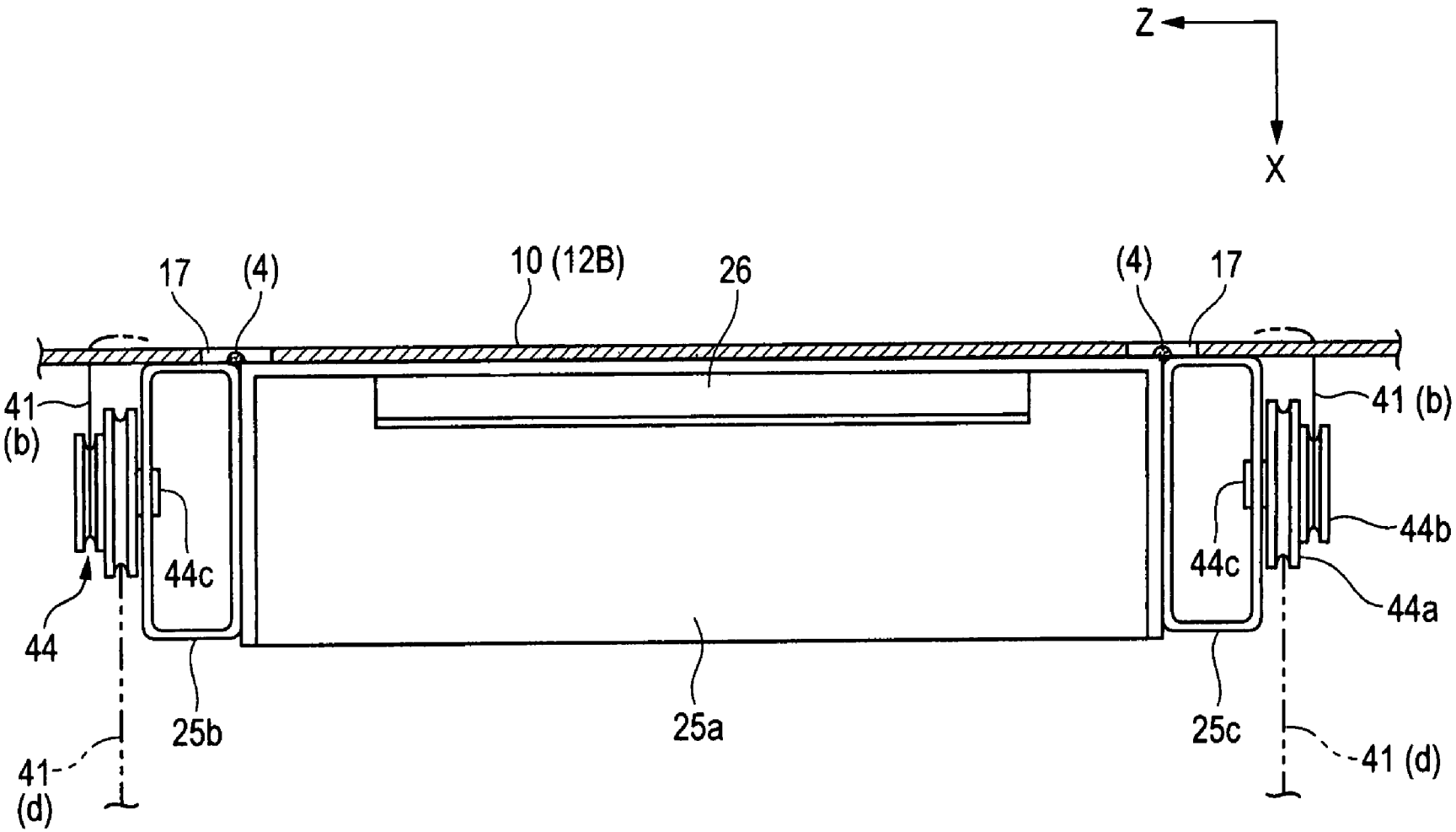
FIG. 10 is a partially sectional explanatory diagram (top view) showing a state that the second carriage which is located at the transport position and is in contact with the outer frame.

Then, as shown in FIGS. 3B and 8-10, the drive operation of the wire drive mechanism 40 is stopped as soon as the second carriage 25 hits the outer frame 12B of the case 10. As a result, the second carriage 25 is kept in a state that it is stopped and fixed by means of the wires 41 while being in contact with the outer frame 12B of the case 10. On the other hand, the first carriage 20 is kept in a state that it is stopped and fixed by the stopped and fixed second carriage 25 via the wires 41 (i.e., the wire end portions 41*d* extending from the rotation-stopped drive pulleys 42 past the double-groove pulleys 44 to the wire fixedly attaching portions 15) without being brought in contact with the outer frame 12B of the case 10 (an interval S is formed). In FIGS. 9, 10, etc., symbol 43*c* denotes a shaft or its bearing portion of the fixed pulleys 43 and symbol 44*c* denotes a shaft or its bearing portion of the double-groove pulleys 44.

The first carriage 20 and the second carriage 25 are stopped and fixed at the transport positions in the above-described manner. In this state, the first carriage 20 and the second carriage 25 are kept not prone to move at least in the vertical direction even when external impact or vibration is applied to them when the image forming apparatus 1 is transported or moved.

However, as described above, when located at the home position, the first carriage 20 is stopped without being brought in contact with the outer frame 12B of the case 10 (an interval S is formed). Therefore, even though located at the home position, the first carriage 20 can move in the read scanning direction X (strictly, in the direction of arrow X2) when the image scanner 1 receives strong external force such as impact. It is inferred that this is due to the facts that the first carriage 20 is merely placed on the slide rails 24 and prevented from moving in the read scanning direction X by the wires 41, and that the wires 41 can move to provide the same effect as would be obtained when they were made longer because their one end portions 41*b* are attached elastically via the tension springs 47 and the drive pulleys 42 are in such a state as to be able to rotate though slightly. If the first carriage 20 is moved from the transport position in the read scanning direction X2, the wires 41 are moved together with it, as a result of which, in the worst case, as described above, the wires 41 come off the closest double-groove pulleys 44 (large-diameter pulleys 44*a*).

In view of the above, in the image scanner 1, a movement restricting member 50 is provided which restricts, to about 1.6 d or less, the maximum movement distance L by which the first carriage 20 is allowed to move from the transport position in the read scanning direction X (in this example, strictly, in the direction of arrow X2), where d (mm) is the depth of the grooves 48 of the pulleys 44 (large-diameter pulleys 44*a*).

In this exemplary embodiment, as shown in FIGS. 1, 8, 9, etc., the movement restricting member 50 is a drawn projection 51 formed by bending, inward, by a degree, a portion, opposed to the first carriage 20, of the outer frame 12B (to which the second carriage 25 is to hit) of the case 10. The drawn projection 51 is formed by forming parallel cuts over and under a portion of the outer frame 12B and bending that portion by pressing it inward from outside the frame, and the drawn projection 51 remains continuous with the outer frame 12B at both ends. The first carriage 20 is formed in such a manner that the side surfaces, facing the outer frame 12B, of the main body 20*a* and the brackets 20*b* and 20*c* are in the same plane.

The reason (hypothesis) whey the maximum movement distance L by which the movement restricting member 50 allows the first carriage 20 to move in the read scanning direction X is set at "about 1.6 d or less" (L≦1.6 d) is as follows.

Figure 11:
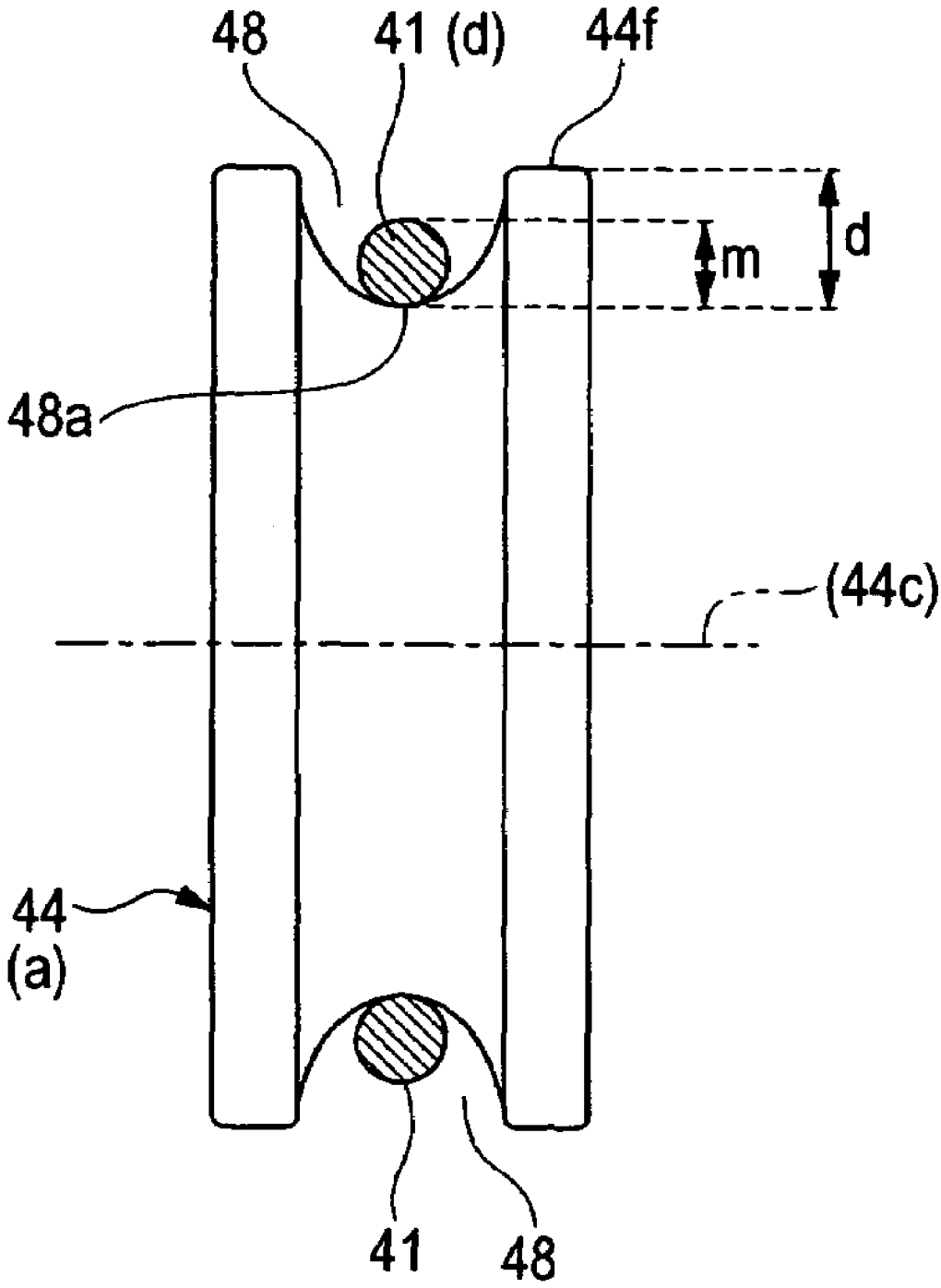
FIG. 11 is an explanatory diagram showing dimensions etc. of individual portions of a pulley and a wire.

It is assumed that, as shown in FIG. 11, the depth d of the groove 48 of each pulley 44 (large-diameter pulley 44*a*) is defined as the height-direction distance from the bottom 48*a* of the pulley groove 48 to the flange tops 44*f*. In the example of FIG. 11, the wire 41 having a diameter m is wound so as to be in contact with the bottom 48*a* of the pulley groove 48.

Figure 12:
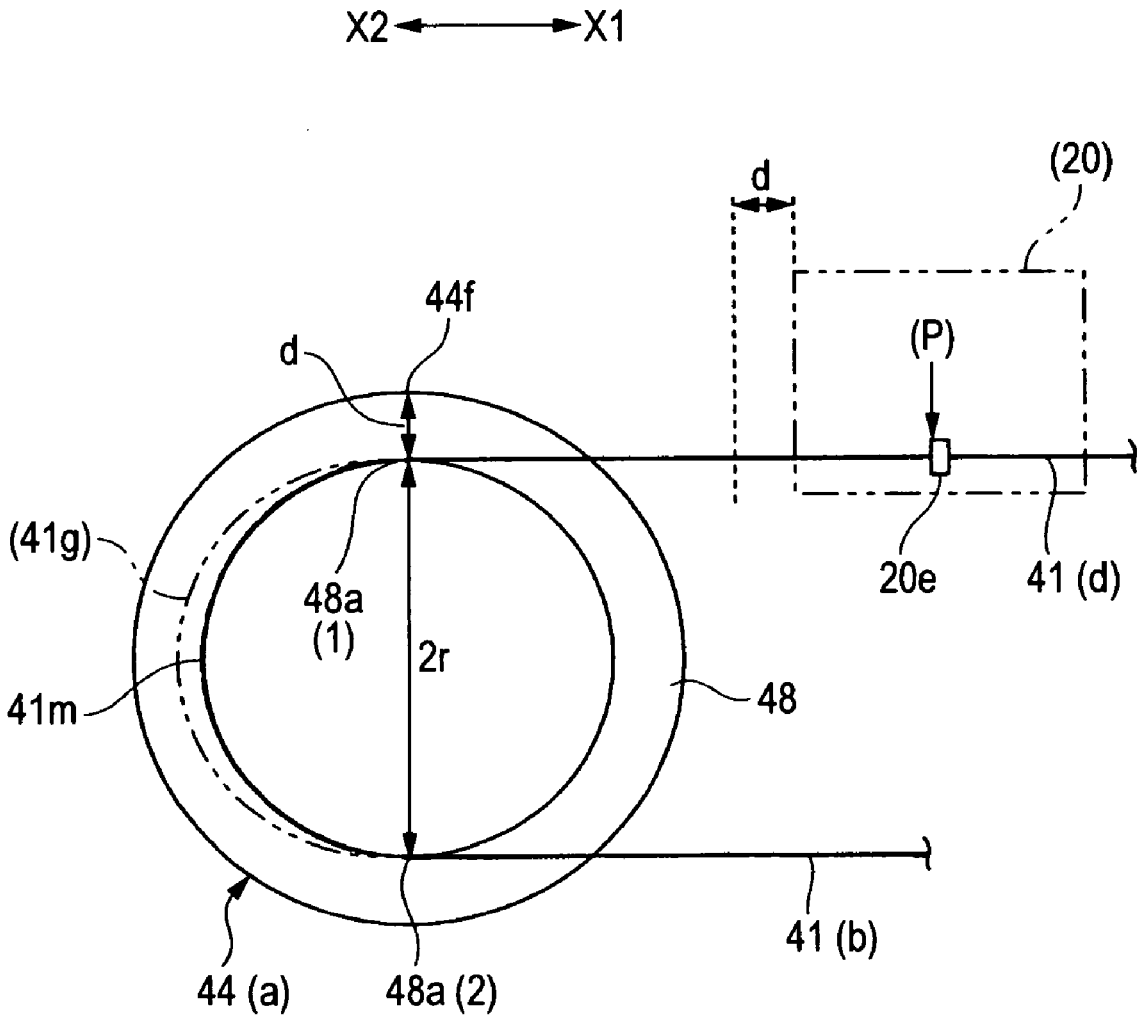
FIG. 12 is an explanatory diagram showing an hypothesis that explains how the wire comes off when the first carriage is moved by a distance that is the same as the depth of a pulley groove.

First, it will be discussed whether or not the wire 41 comes off when, as shown in FIG. 12, the first carriage 20 is moved by the distance that is the same as the depth d of the pulley grooves 48 from the transport position in the read scanning direction (direction X2). In this case, it is predicted that the movement of the carriage 20 will directly cause movement of the wire 41*d* in the direction of arrow X2 and finally result in circumferential elongation of a wire portion 41*e* that is wound on the pulley 44. A two-dot chain line in the figure indicates a predicted state of a circumference-elongated wire portion 41*g*, and symbol P denotes the position of the pulley-44-side wire end of the wire fixedly attaching portion 20*e*.

Incidentally, the circumferential elongation length is given by the following equation. In the equation, r is the radius of the bottom 48*a* of the pulley groove.

(Circumferential elongation length due to movement of distance that is the same as groove depth d)

$$=(2\pi r/2)+d=\pi r+d$$

That is, in this case, it is inferred that the wire 41 does not come off or is not prone to come off because the circumference-elongated wire portion 41*g* is engaged with an upper groove bottom 48*a*(1) and a lower groove bottom 48*a*(2) and exists in the groove 48 as a whole (in other words, the wire 41 is engaged with the flanges).

Figure 13:
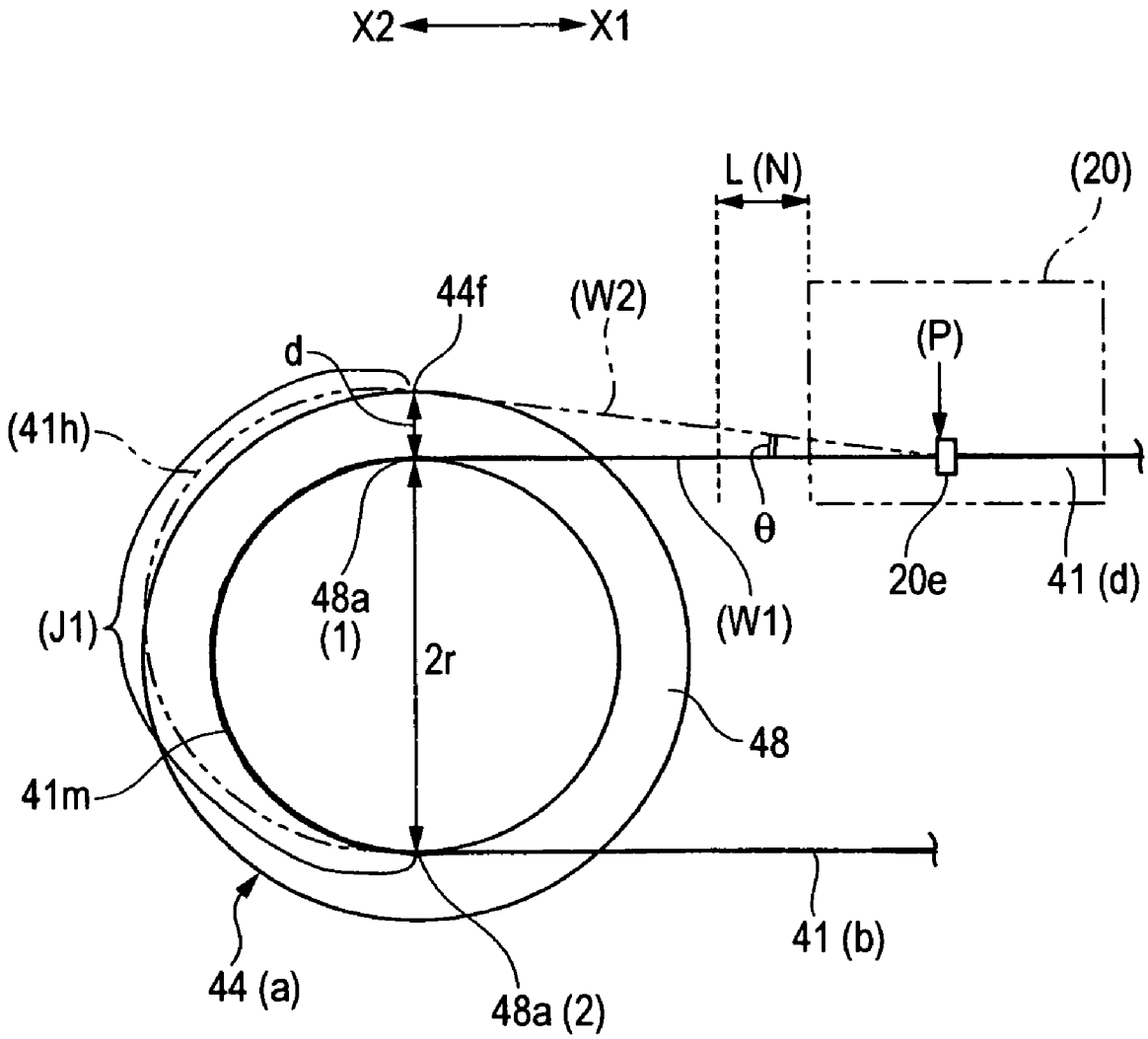
FIG. 13 is an explanatory diagram showing a method for determining a movement distance of the first carriage that causes coming-off of the wire.

It is then inferred that the wire 41*d* that extends from the first carriage 20 and is wound on the pulley 44 actually comes off (the groove 48 of) the pulley 44 at a high probability if the wire 41*d* in a state of FIG. 13, that is, in a state that the wire 41*d* projects from the flanges (their tops 44*f*) of the pulley 44 over a quarter or more of the circumference (wire portion 41*h*). Based on this inference, we think that the difference between the length of the wire portion 41*h* being in the above state and the length of a normal wire portion 41*m* (the first carriage 20 is not moved) is equal to the movement distance N of the first carriage 20, that is, the above-mentioned maximum movement distance L.

Based on the above discussion, the movement distance N of the first carriage 20 in a state that the wire 41*d* projects from the flanges of the pulley 44 over a quarter or more of the circumference is calculated according to the following equation:

(Movement distance N of first carriage 20)

$$=(J1-J2)+\alpha$$

In this equation, J1 is the length of the wire portion 41*h* from the upper groove bottom 48*a*(1) to the lower groove bottom 48*a* (2) in a state that it projects from the flanges over a quarter or more of the circumference and is given by J1={π(2r+d)}/2. The parameter J2 is the length of the wire portion 41*m* that is that portion of the wire 41*d* which is wound being in contact with the groove bottom 48*a*, and is given by J2=2rπ/2. The parameter α is the elongation length (of a wire portion W2) when a wire portion W1 extending from the end position P of the wire fixedly attaching portion 20*e* to the upper groove bottom 48*a*(1) runs onto a flange top 44*f*. For example, the elongation length α is given by $$\alpha=W2-W1=(W1/\cos\theta)-W1=(d/\sin\theta)-W1$$

where θ is the angle formed by the normal wire portion W1 and the wire portion W2 that runs onto the flange top 44*f*.

Substituting the above into the calculation formula of the movement distance N of the first carriage 20, we obtain (Movement distance N of first carriage 20)

$$=(J1-J2)+\alpha$$

$$=[\{\pi(2r+d)\}/2-\pi rJ+\alpha$$

$$=(\pi/2)d+\alpha.$$

Since, as this result shows, the movement distance N of the first carriage 20 is given by N=(π/2)d+α, the wire 41 comes off the pulley 44 if N exceeds this value. Therefore, satisfactory results should be obtained formally as long as the maximum movement distance L is set less than or equal to N=(π/2)d+α. However, in this case, the term α can be eliminated because it is much smaller than (π/2)d. Furthermore, since (π/2)=1.5707963 . . . , it can be approximated as 1.6. This can also be understood as including the deviation α to some extent.

Based on the above discussion, it has been decided, as a general rule, to set the maximum movement distance L so that it satisfies L≦1.6 d.

Actual image scanner 1 were prepared according to the exemplary embodiment in which the groove depth d of the pulleys 44(*a*) was 1.5 mm and the maximum movement distance L was set at 2.4 mm and 0.7 mm by means of the drawn projection 51 (movement restricting member). Whether or not the wires came off the pulleys 44 (large-diameter pulleys 44*a*) was checked by applying artificial vibration of the same conditions. The wires did not come off in either case.

Furthermore, in the image scanner 1, as shown in FIG. 4, through-holes 17 as escape holes are formed in the outer frame 12B at positions that face the attachment boundaries between the main body 25*a* and the brackets 25*b* and 25*c* of the second carriage 25. With this measure, even if weld projections (weld beads) 4 exist at the attachment boundaries between the main body 25*a* and the brackets 25*b* and 25*c* of the second carriage 25 so as to project from the surfaces of the main body 25*a* and the brackets 25*b* and 25*c* to the outer frame 12B side, the weld projections 4 can escape into the through-holes 17 without hitting the frame 12B when the second carriage 25 hits the outer frame 12B in the transport position mode as shown in FIGS. 9, 10, etc.

Although in this exemplary embodiment the movement restricting member 50 is provided on the outer frame 12B of the case 10, it may be provided on the first carriage 20. The invention is not limited to the case that only one movement restricting member 50 is provided; plural movement restricting members 50 may be provided. And the position of the movement restricting member 50 is not limited to the position in the exemplary embodiment; the movement restricting member 50 may be provided at another position if necessary.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image scanner for a document, comprising:

a case having a document placement surface on which a document is placed;

rails disposed inside the case along a read scanning direction which is parallel with the document placement surface;

two carriages comprising a first carriage and a second carriage which have optical components and move by running on the rails;

a fixedly disposed member disposed on one end side in the read scanning direction, the fixedly disposed member stopping and fixing one of the two carriages;

a wire drive mechanism having a plurality of pulleys and wires each of which is wound on and stretched between the plurality of pulleys, the wire drive mechanism reciprocating the two carriages which are coupled to the wires; and a movement restricting member that restricts a maximum movement distance of the first carriage in a stationary position mode to about 1.6 d or less, d being a groove depth of pulleys in mm and the maximum movement distance being a distance by which the first carriage is allowed to move in the read scanning direction in the stationary position mode in which the first carriage is kept stopped and fixed via the wires by moving the second carriage by causing the wire drive mechanism to operate so that the second carriage hits the fixedly disposed member to be stopped and fixed.

2. The image scanner according to claim 1, wherein the movement restricting member is a drawn projection formed by bending a portion of the case.

* * * * *